US006452555B1

(12) United States Patent
Chang et al.

(10) Patent No.: US 6,452,555 B1
(45) Date of Patent: Sep. 17, 2002

(54) MULTI-FREQUENCY HELIX ANTENNA

(75) Inventors: Dainel Chang, Pa-Te; Chiang Chi-Ming, Pateh, both of (TW)

(73) Assignee: Auden Techno Corp. (TW)

( * ) Notice: Subject to any disclaimer, the term of this patent is extended or adjusted under 35 U.S.C. 154(b) by 0 days.

(21) Appl. No.: 09/767,749

(22) Filed: Jan. 24, 2001

(51) Int. Cl.[7] ..... H01Q 1/24
(52) U.S. Cl. ..... 343/702; 343/895
(58) Field of Search ..... 434/702, 872, 434/745, 895

(56) References Cited

U.S. PATENT DOCUMENTS 5,006,861 A * 4/1991 Miller ..... 343/848
6,052,088 A * 4/2000 Simmons et al. ..... 343/702
6,140,973 A * 10/2000 Annamaa et al. ..... 343/790

* cited by examiner

*Primary Examiner*—Don Wong
*Assistant Examiner*—Shih-Chao Chen
(74) *Attorney, Agent, or Firm*—Troxell Law Office PLLC

(57) ABSTRACT

A multi-frequency helix antenna with a helical column having its diameter, material, pitch of circles as well as the total length thereof preset, the top end of the helix antenna has a radially extending section bent inwardly along the central axis of the helical column itself, a predetermined length is bent integrally from the end of the radially extending section orthogonally to extend inwardly along the central axis of the helical column of said helix antenna itself, the antenna is endued with an alternative waving frequency value and the value of the capacity and inductance of the antenna match with each other to give the antenna an equivalent resistance to thereby form a complete harmonic oscillation.

4 Claims, 6 Drawing Sheets

MULTI-FREQUENCY HELIX ANTENNA

BACKGROUND OF THE INVENTION

1. Field of the Invention

The present invention is related to a novel structural design of multi-frequency helix antenna, and especially to a set of communication equipment such as a mobile phone which can get the function of multi-frequency with a simple helical coil structure.

2. Description of the Prior Art

It is the primary antenna type having a helical coil made from winding of a metal wire, diameter and material of the coil as well as the total length of such a helix antenna can influence the set functions thereof. However, such a helix antenna still is widely adopted and has a quite stable signal emitting and receiving structure. In meeting the requirement of modern communication equipment, such a helix antenna can get various resonance frequencies through different structural designs. For example, a helical coil can be provided in an external sleeve, and an adjusting member is extended in the external sleeve, extending length of the adjusting member determines its resonance frequency. However, such structure not only increases complexity of production, but also increases cost of production.

Thereby, there are various miniaturized and planar microstrip antennas being developed gradually. However, earlier microstrip antennas, such as are disclosed in U.S. Pat. Nos. 3,921,177 and 3,810,183, generally are made from round or rectangular thin metallic rods, dielectric substance is filled in the space between such an antenna and the grounding member. Such a microstrip antenna generally can only allow narrower bandwidth. U.S. patent application No. 07/695686 provides a polygonal helical microstrip antenna which is improved against the earlier microstrip antennas, the bandwidth thereof can approach that of a normal helix antenna with a constant impedance. But this microstrip antenna is disadvantageous in having quite a large diameter when in low frequency, and does not suit modern portable communication equipment such as mobile phones.

Pointing to this, U.S. patent application No. 07/798700 (Taiwan patent no.81108896) provides a smaller microstrip antenna of broadband. However, the helical antenna element thereof is provided on a grounding plate, and dielectric substance and bearing material of specific thickness are filled in the space between it and the plate; the antenna can hardly further be reduced, and its signal emitting and receiving function is inferior to that of a helix antenna.

SUMMARY OF THE INVENTION

The object of the present invention is to provide a multi-frequency helix antenna capable of getting the function of multi-frequency with a simple and low cost helical coil structure.

To get the above stated object, the present invention is provided with a helix antenna with a helical column having its diameter, material, pitch of circles as well as the total length thereof preset, and the top section thereof is changed in its extending direction to be oriented inwardly along the axis of the helical column of the helix antenna itself, i.e., a predetermined length from the end of the radially extending section is integrally bent orthogonally inwardly along the central axis of the helical column of the helix antenna itself to form the multi-frequency helix antenna.

In a practicable embodiment of the present invention, the antenna can be combined to an upper surface of a metallic receiving seat, a coating layer is added to the antenna by injection enveloping.

In another embodiment of the present invention, the receiving seat of the helix antenna having been assembled can be combined to a corresponding connecting hole on the top surface of a mobile phone by means of an insertion section thereof.

The present invention will be apparent in its novelty and other characteristics after reading the detailed description of the preferred embodiment thereof in reference to the accompanying drawings.

DETAILED DESCRIPTION OF THE PREFERRED EMBODIMENT

Referring to FIGS. 1–4, a helix antenna 10 with a helical column of the present invention can have its diameter, material, pitch of circles as well as the total length thereof preset.

The main feature of the present invention is resided in that the top end of the helix antenna 10 has a radially extending section 12 bent inwardly along the central axis of the helical column of the helix antenna 10 itself. The length of the radially extending section 12 is about half the length of the diameter preset for the helix antenna 10, a predetermined length 16 from the end 14 of the radially extending section 12 itself can be bent orthogonally to extend inwardly along the central axis of the helical column of the helix antenna 10.

A normal helix antenna can make the capacity and inductance of the antenna match with each other and the value of resistance can be an equivalent resistance to form a complete harmonic oscillation when an alternative waving frequency value is added to the antenna, because the amount of inductance, capacity and resistance are averagely distributed in the linear conductive material. Frequency of matching of the above stated embodiment of the present invention can be obtained from the following formulae:

By the fact that inductive impedance $Z\ L=jwL$, wherein, $j=\sqrt{-1}$, $W=2\pi f$;

while capacitive impedance $Z\ c=1/jwC$, to make the two matched with each other, it requires that $Z\ L$ $+Z\ c=0$, thereby, frequency of matching $f=\frac{1}{2}\pi\sqrt{LC}$.

The helix antenna 10 and the predetermined length 16 integrally extending from the former in the aforesaid embodiment of the present invention can form a complete harmonic oscillation when the value of resistance is an equivalent resistance and the selected capacity and inductance of the antenna match with each other, thus another resonant frequency is created with an increased bandwidth.

Figure 1:
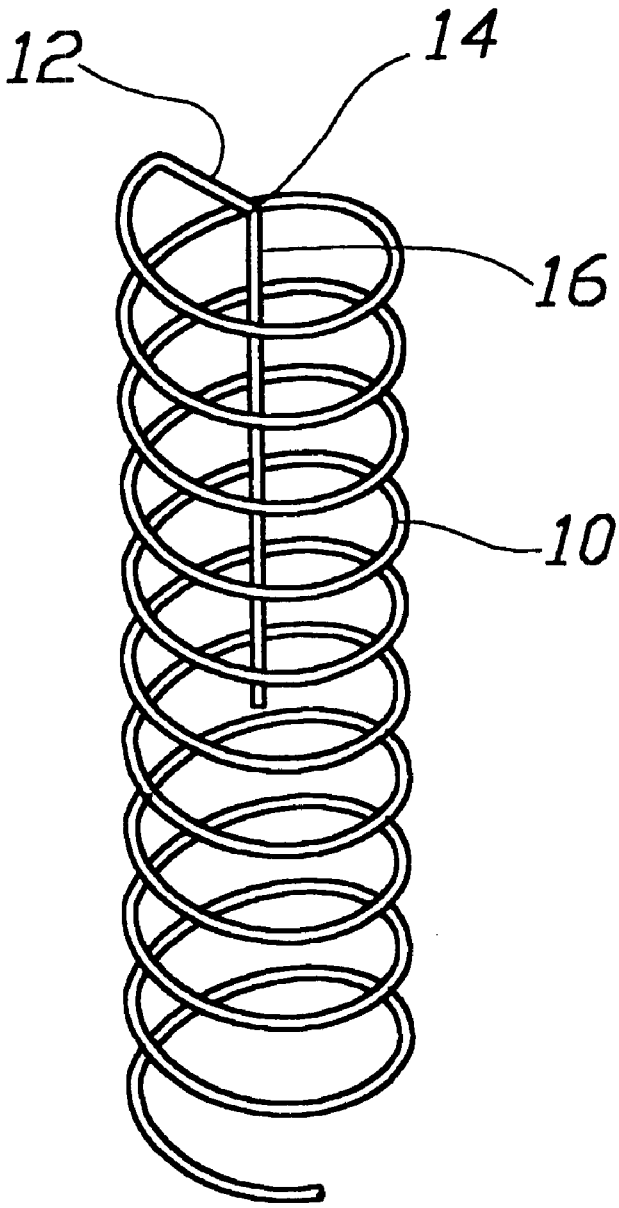
FIG. 1 is a perspective view showing a preferred embodiment of the present invention.
Figure 2:
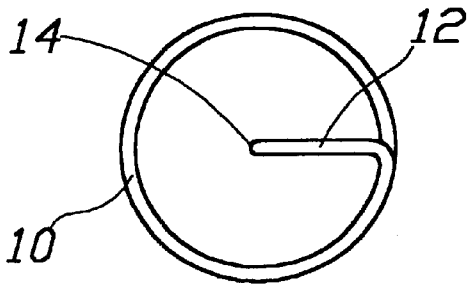
FIG. 2 is a top view of FIG. 1.
Figure 3:
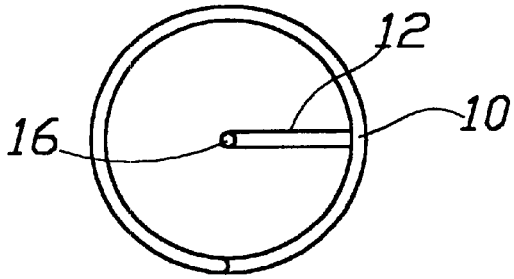
FIG. 3 is a bottom view of FIG. 1.
Figure 4:
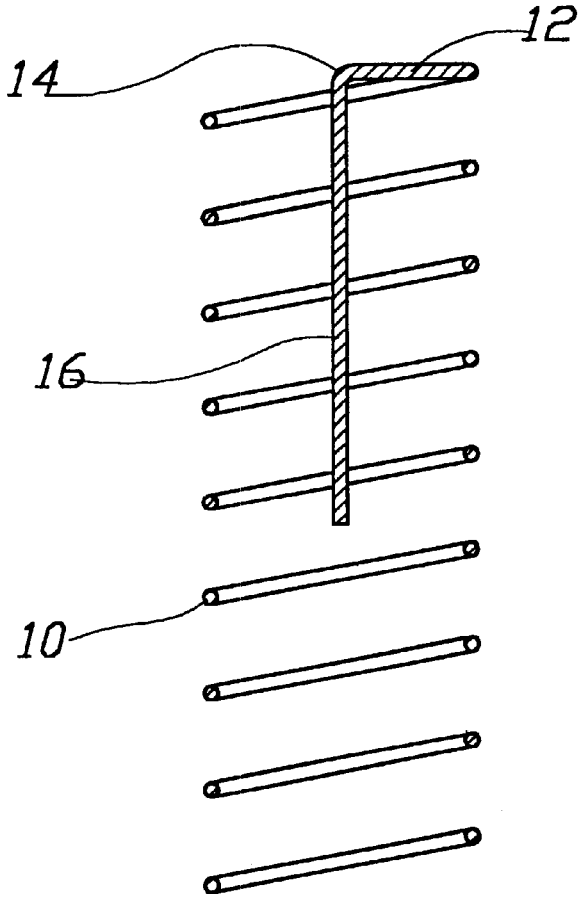
FIG. 4 is sectional view taken from FIG. 4.
Figure 5:
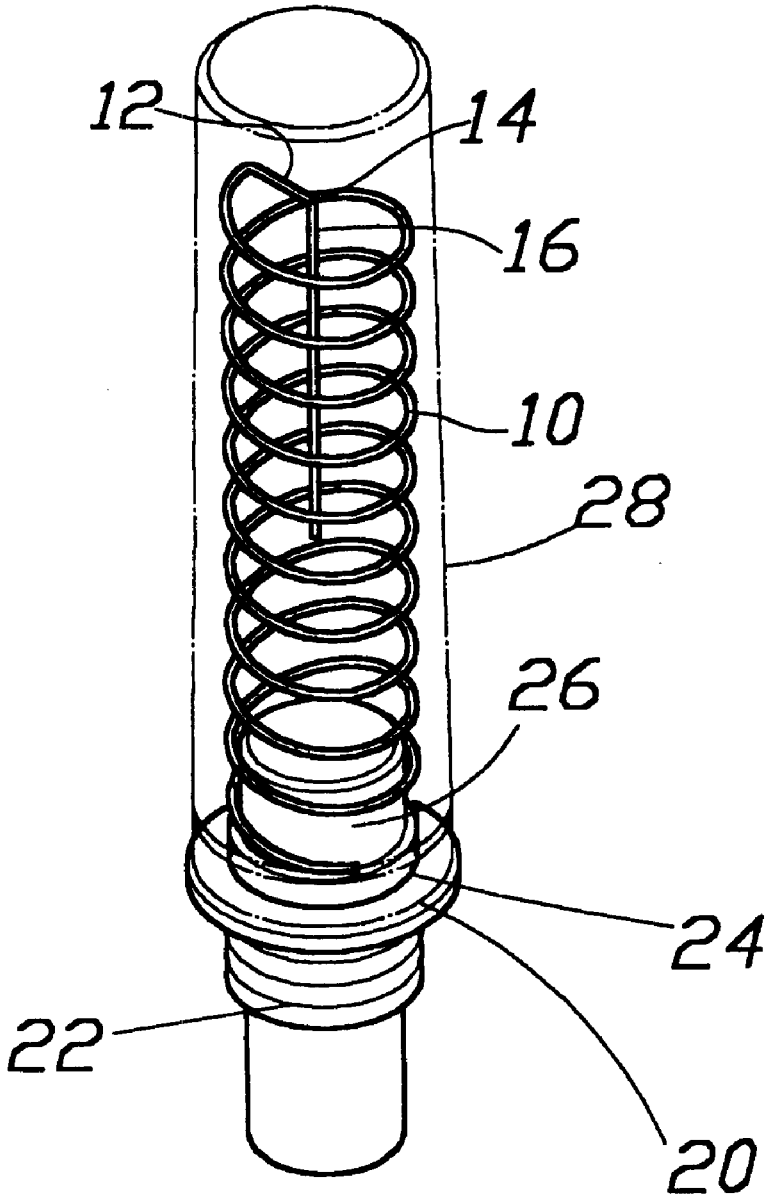
FIG. 5 is a schematic view showing assembling of the above embodiment on a set of communication equipment.
Figure 6:
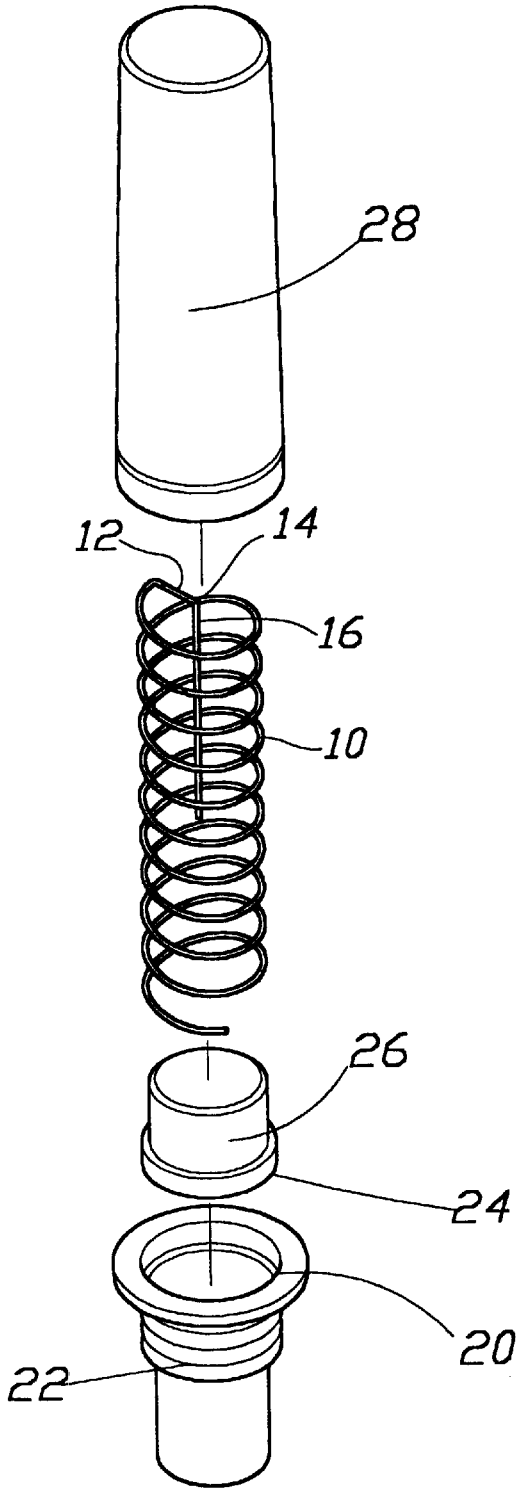
FIG. 6 is an analytic perspective from FIG. 5.

Referring to FIGS. 5, 6, the entire helix antenna in the aforesaid embodiment can be assembled on a receiving seat 20 generally made of metallic material, the receiving seat 20 is provided with a bottom insertion section 22 and a seat portion 24 on the top thereof. The seat portion 24 has an upwardly extending section 26 matchable with the diameter of the helix antenna, so that the lower portion of the helix antenna can be fitted over the upwardly extending section 26 for positioning, and then a coating layer 28 is added to the antenna by injection enveloping.

Figure 7:
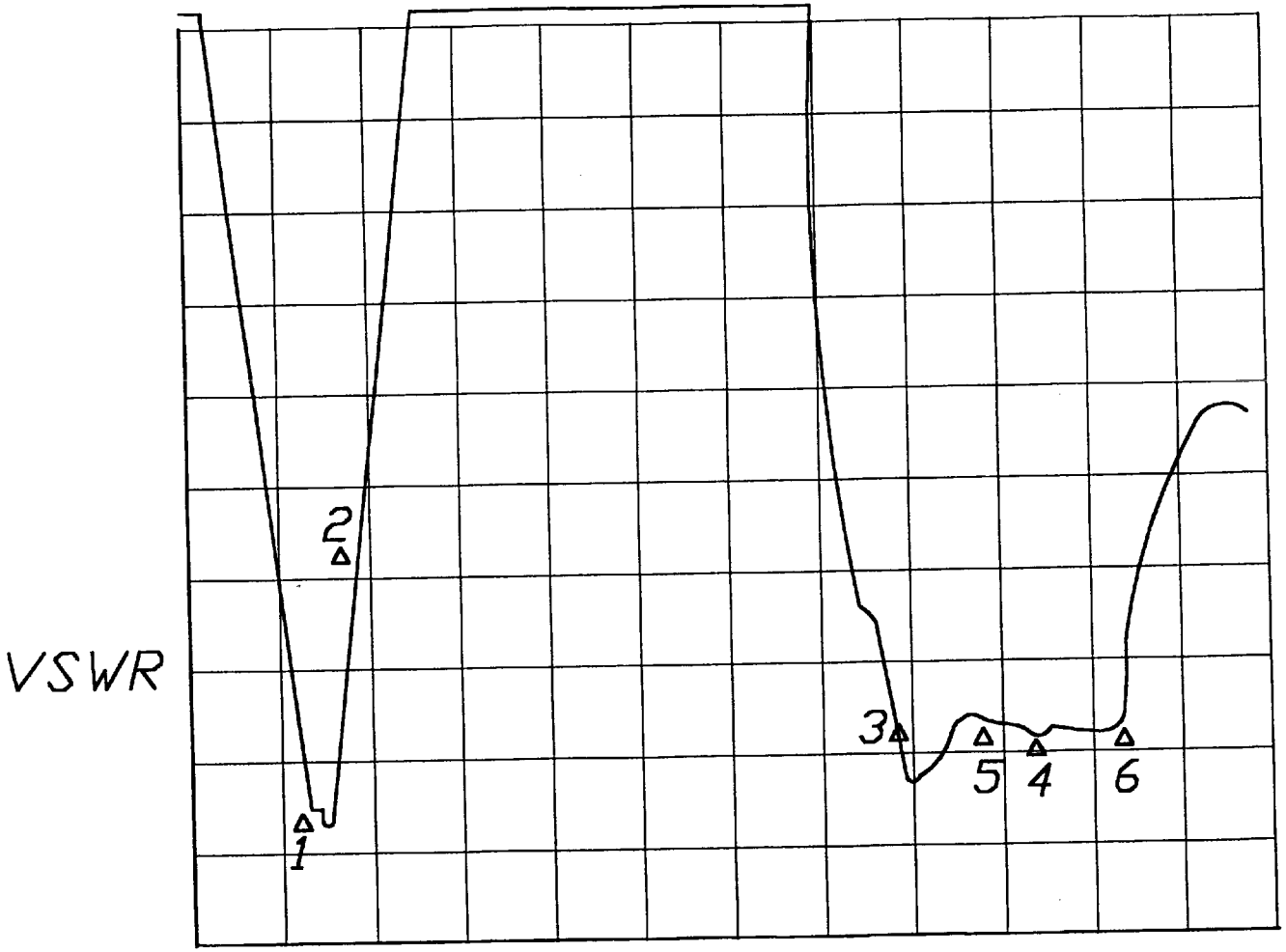
FIG. 7 is a test chart of frequency of a tangible article of the embodiment of the present invention.
Figure 8:
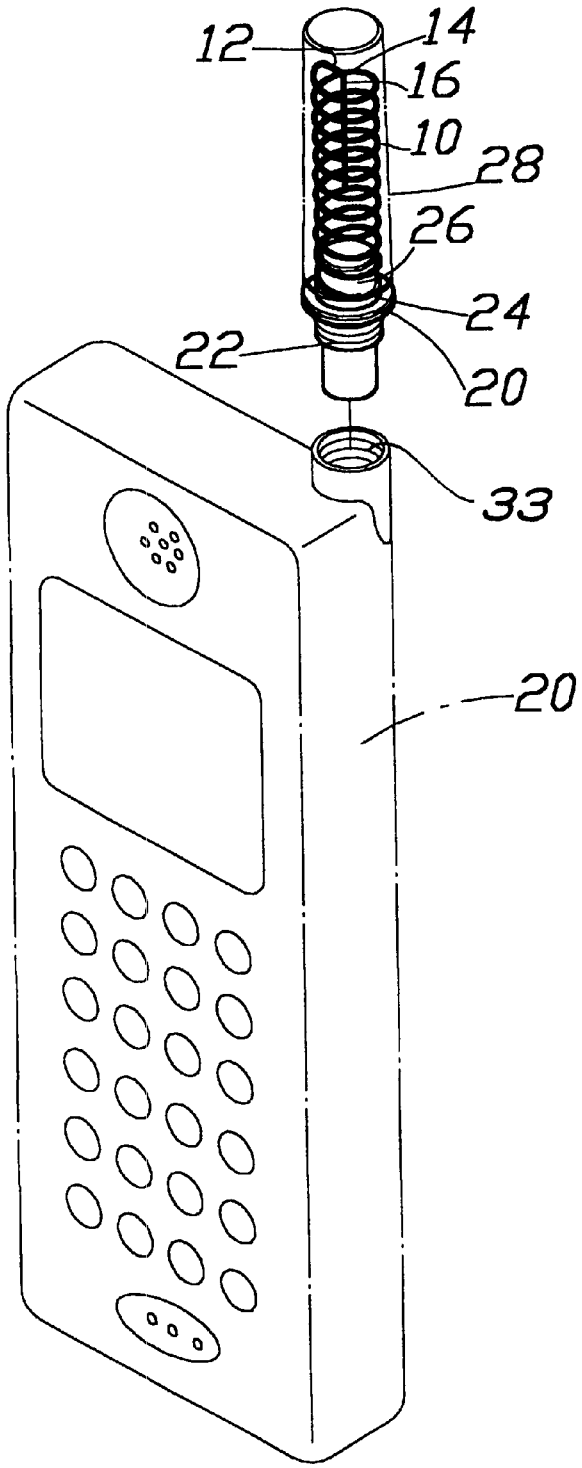
FIG. 8 is a schematic view showing application of the embodiment of FIG. 5 on a mobile phone.

As shown in FIG. 7, it shows a result from a test of a tangible article of the embodiment of the present invention, wherein, frequency at the first point is 890 MHZ, frequency at the second point is 960 MHZ, at the third point 1710 MHZ, at the fourth point 1880 MHZ, at the fifth point 1850 MHZ and at the sixth point 1990 MHZ. The frequency at the sixth point can get to 1990 MHZ, we can see that the function of multi-frequency of the present invention is quite superior.

The aforesaid receiving seat 20 of the helix antenna of the present invention can have its insertion section 22 inserted into a connecting hole 33 on a top surface of a mobile phone.

The entire helix antenna of the present invention not only is characterized in multi-frequency and increased bandwidth, but also in that it can have the radially extending section integrally made on a common helix antenna and extended inwardly along the central axis of thereof. Thereby, it has the advantages of simplicity of structure, easiness of production as well as lowness of cost.

The preferred embodiment stated is only for illustrating a preferred embodiment of the present invention. It will be apparent to those skilled in this art that various modifications or changes can be made to the elements of the present invention without departing from the spirit and scope of this invention. Accordingly, all such modifications and changes also fall within the scope of the appended claims and are intended to form part of this invention.

What is claimed is:

1. A multi-frequency helix antenna comprising:

a) a helical column having a predetermined diameter and a pitch of circles, the helical column having opposite ends;

b) a first section extending radially inwardly from one of the opposite ends of the helical column toward a central axis of the helical column; and, c) a second section extending from the first section into the helical column, the second section being located entirely within the helical column, whereby the antenna has an alternative waving frequency value, and values of capacity and inductance match with each other to give the antenna an equivalent resistance to thereby form complete harmonic oscillation.

2. The multi-frequency helix antenna as defined in claim 1 wherein, the frequency of matching of said helix antenna is $f=\frac{1}{2}\pi\sqrt{LC}$, wherein, C is capacity and L is inductance.

3. The multi-frequency helix antenna as defined in claim 1 further comprising a receiving seat provided with a bottom insertion section and a top seat portion having an upwardly extending section engaged with a lower portion of said helical column, and a coating layer added to said helix antenna by injection enveloping.

4. The multi-frequency helix antenna as defined in claim 3, further comprising an insertion section on said receiving seat, said insertion section configured to be inserted into a connecting hole on a mobile phone.

* * * * *